United States Patent [19]

Hancock

[11] 3,980,206

[45] Sept. 14, 1976

[54] DISHWASHER WETTING AGENT DISPENSER

[75] Inventor: Charlie L. Hancock, Frazeysburg, Ohio

[73] Assignee: White-Westinghouse Corporation, Cleveland, Ohio

[22] Filed: Oct. 10, 1974

[21] Appl. No.: 513,916

[52] U.S. Cl. ..... 222/156; 222/363; 222/454; 134/93

[51] Int. Cl.[2] ..... G01F 11/10

[58] Field of Search ..... 222/70, 162, 164–166, 222/424, 454, 464, 353, 359, 361–362, 369, 54, 564, 23, 356, 363, 156; 134/93, 100, 101, 57 DL, 58 DL, 57 D, 58 D; 141/309

[56] References Cited

UNITED STATES PATENTS

| | | | |
|---|---|---|---|
| 3,013,568 | 12/1961 | Getchell et al. | 222/70 X |
| 3,029,826 | 4/1962 | Fink et al. | 222/54 X |
| 3,152,723 | 10/1964 | Perl et al. | 222/23 |
| 3,212,675 | 10/1965 | Krzewina | 222/369 X |
| 3,220,607 | 11/1965 | Seal | 222/70 X |
| 3,426,688 | 2/1969 | Jones | 222/369 X |

FOREIGN PATENTS OR APPLICATIONS

| | | | |
|---|---|---|---|
| 430,912 | 6/1926 | Germany | 222/356 |

*Primary Examiner*—Robert B. Reeves
*Assistant Examiner*—Charles A. Marmor
*Attorney, Agent, or Firm*—Strauch, Nolan, Neale, Nies & Kurz

[57] ABSTRACT

In a dishwasher wetting agent dispenser mounted in the door of a front-loading type dishwasher, a tiltable bucket within the dispenser pours a measured amount of fluid into a charge-discharge structure from which it flows by gravity into the washing chamber of the dishwasher. The components of the dispenser are arranged so that the dispenser will not leak when the dishwasher door is in its normal positions; including a break-away position if the door is on a dishwasher which permits such a position. The dispenser provides an air lock feature which prevents overfilling of the dispenser reservoir. A mounting arrangement of the dispenser to the door assures proper orientation therebetween. Also, a translucent rod may be attached to the dispenser to indicate when the dispenser reservoir requires filling.

7 Claims, 11 Drawing Figures

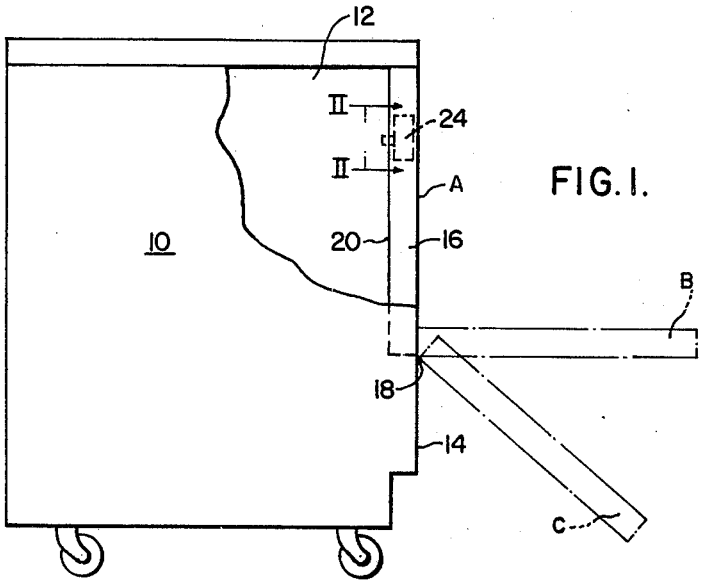
FIG. 1.
FIG. 2.
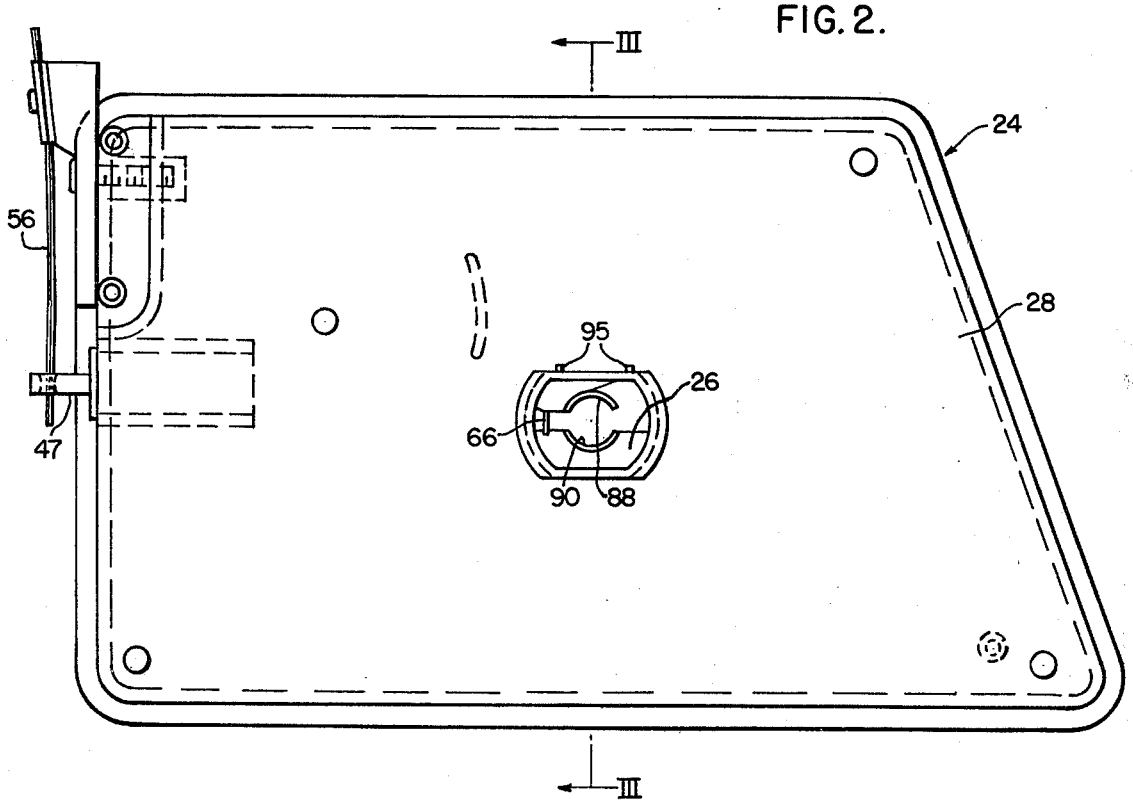

DISHWASHER WETTING AGENT DISPENSER

BACKGROND OF THE INVENTION

Dishwasher wetting agent dispensers of the prior art have used many methods for dispensing a measured amont of fluid at a predetermined time. However, some of these methods are not suitable for use with those portable and convertible dishwashers of the front-loading type having a break-away door arrangement which allows the door to swing downward from a substantially horizontal position when an excessive amount of weight is placed on the door. The break-away door prevents damage to the dishwasher door or hinge and also prevents the dishwasher from toppling forward and injuring someone. Use of door mounted wetting agent dispensers of the prior art, in these models, would allow leakage when the dishwasher door is in this breakaway position. An example of such a dispenser is shown in U.S. Pat. No. 3,029,826.

The dispenser construction of that patent includes a valve arrangement or controlling the discharge of the rinse agent to the dishwasher chamber. It is my view that a valve arrangement introduces problems in the discharge of the relatively viscous rinse agent liquid because of the limited clearance at the valve seat and the surface tension restraint against flow of the liquid in the limited clearance area. Therefore it is believed preferable to provide a construction in which the flow out of the dispenser is not through a limited clearance area. However if a valve arrangement is omitted, this means that there exists an opening in a wall of the dispenser which is always in open communication with the atmosphere. This leads to its own problem in that if no positive closure valve arrangement for the outlet of rinse agent to the dishwasher chamber is provided, then during a fill operation the container can be overfilled because of the always open outlet from the container. The overfill situation might not be disadvantageous in a valve type dispenser, and particularly one which is not incorporated in a breakaway door, but it would lead to significant problems if incorporated in a breakaway door. A part of the invention is directed to the solution of that problem.

Another disadvantage of the valve arrangement in my view is that with the positive closure effected by the valve whenever the agent is to be released from the container by opening the valve a partial vacuum situation arises unless some vent means or other open area is provided in the container, as is the case in the noted patent. However, such open areas or vents will again lead to potential leakage problem if the dispenser is incorporated in a breakaway door. In the arrangement of my invention open communication exists between the interior of the container and atmosphere so that no vacuum situation is created upon the discharge of the rinse agent. However as noted before, that open communication arrangement does lead to the problem of overfill, which my invention solves by having the container air tight save for a common charge-discharge opening or conduit and which is arranged to effect an air lock during the fill operation to prevent an overfill.

SUMMARY OF THE INVENTION

In accordance with the invention, a single, open-ended, charge--discharge conduit is provided in the wall of the dispenser container facing the dishwashing chamber when the door is in a vertical position for both charging said container with liquid and for discharging the liquid to the dishwasher chamber, with the conduit having its inner end at an intermediate level in the container when the door is in a horizontal position, this level constituting the correct charge for the container. A tiltable bucket which has a hold and dump position serves as a volume-metering dispensing element after receiving the liquid through movement of the door from a horizontal to a vertical position, and shaft means extending in substantially sealed relation to an opening in the wall of the container and operable to position the bucket is arranged with the opening in which it is located being disposed so that opening is always above the level of the liquid in the container regardless of the movement of the door.

Further in accordance with the invention, the arrangement includes means for directing excess liquid transferred to the bucket to the opening and shaft means to provide a liquid seal between the shaft and opening, and an arrangement is provided so that when the bucket dumps the liquid which is received on the outer surface of the open-ended conduit is passed around to the interior of the conduit. Finally, an arrangement for mounting the dispenser to the inner panel of the dishwasher door includes wedge elements on the upper flat surface of the outwardly projecting portion of the conduit means for wedging the bottom flat surface of that projecting portion tightly against a complementary flat edge in an opening of the inner panel to ensure that the proper orientation of the dispenser to the panel is obtained.

Independently of the problem of overfilling the dispenser, it has been difficult for the user to determine the level of liquid within the dispenser. As a result, dispensers of the prior art may easily be overfilled. One method of measuring the liquid level in the dispenser has been to equip the dispenser cap with the translucent rod indicator. A wetting agent dispenser with a liquid level indicator of the translucent rod type is shown in U.S. Pat. No. 3,152,723. However, since this liquid level indicator is attached to the dispenser cap, the user cannot read the liquid level while filling the dispenser. In the present invention, a translucent rod indicator is attached to the dispenser so that the user can read the indicator as he is filling the dispenser.

DESCRIPTION OF THE DRAWINGS

FIG. 1 is a partially broken side elevational view of a front-loading dishwasher with a door mounted dispenser embodying the invention.

FIG. 2 is an elevational view taken along lines II—II of FIG. 1 in which the inner panel of the door has been broken away;

DESCRIPTION OF THE PREFERRED EMBODIMENT

Figure 3:
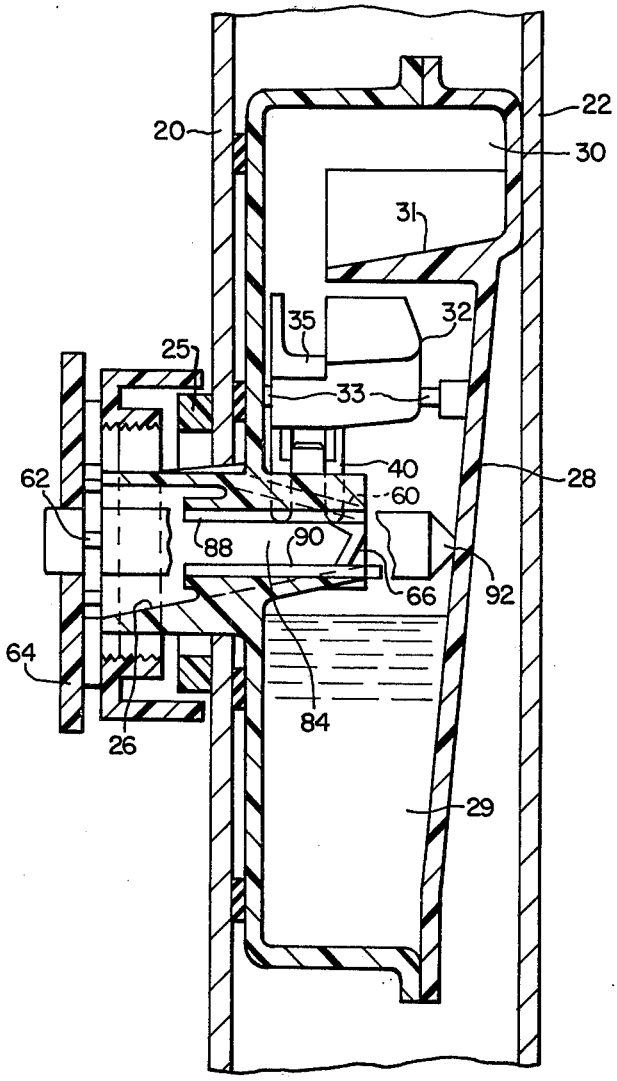
FIG. 3 is a cross section of the dispenser taken along line III—III of FIG. 2, when the door is in the vertical, closed position of A of FIG. 1.

Referring to FIG. 1 of the drawings, a dishwasher which contains the liquid dispenser embodying the invention is designated generally by the numeral 10 and includes a dish chamber 12 enclosed by a cabinet 14. The cabinet 14 is provided at the front with a door 16 pivotally connected to the cabinet 14 adjacent the lower edge of the door by a hinge 18. Thus, the door is pivotal in normal use between a generally vertical, closed position as seen in position A of FIG. 1; and a generally horizontal, open position as seen in position B of FIG. 1. The door 16 has means which resists the opening of the door beyond its normally open horizontal position but which yields to permit the door to swing down until stopped by the floor when a downward force is imposed on the door which exceeds that downward force imposed on the door in its normal use and which would tend to cause the appliance to tip but for the yielding. One example of such means is described in U.S. Pat. No. 3,639,025. Position C of FIG. 1 shows the door in this break-away position.

Figure 11:
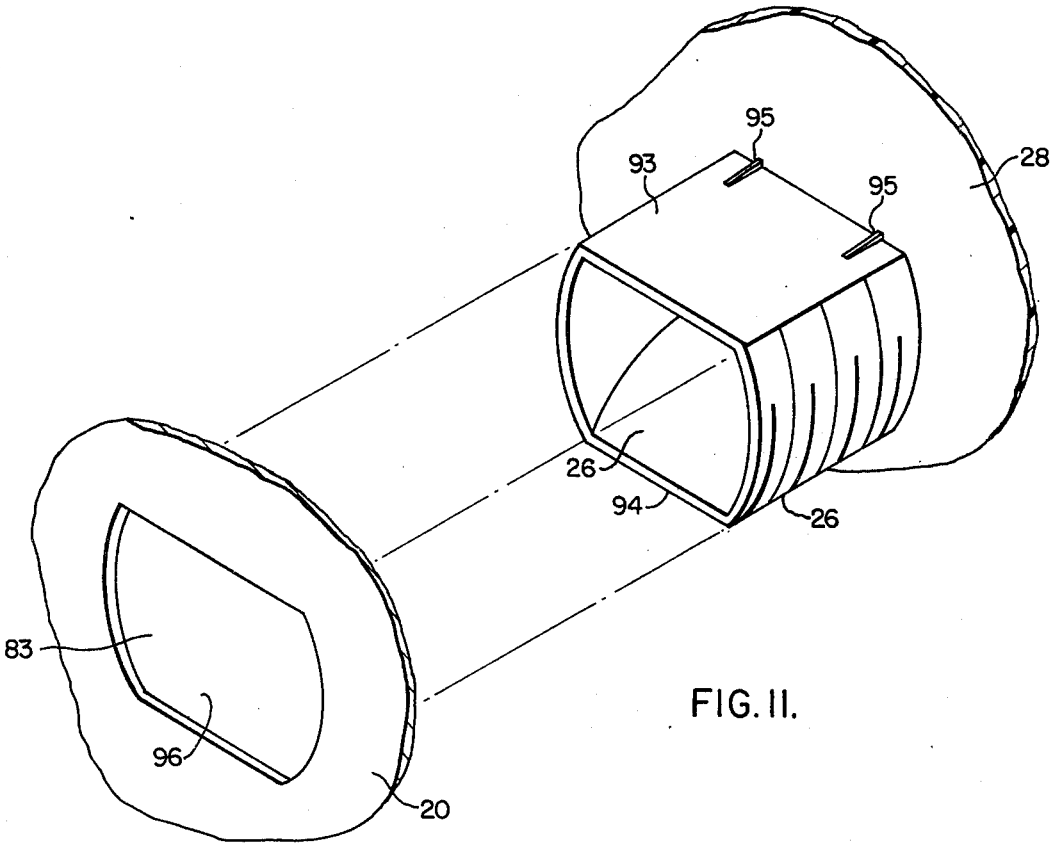
FIG. 11 is a fragmentary, exploded isometric veiw of structure relating to the preferred mounting arrangement for the dispenser.

The door 16 provides a dispenser compartment formed by spaced inner and outer panels 20 and 22, respectively, containing a wetting agent dispenser 24 (FIGS. 1 and 2) which will dispense a metered quantity of wetting agent into the dish chamber 12 at one or more points in the operating cycle of the dishwasher. The dispenser's position in the dispenser compartment is fixed by a nut 25 (FIG. 3) threaded onto the conduit 26 whose shape is best seen in FIG. 11, which conduit protrudes through a hole in the inner panel 20.

The wetting agent dispenser 24 (FIG. 3) is preferably formed as a number of molded plastic parts assembled together and includes an outer wall 28, a reservoir 29, a reservoir sump 30 and a shelf 31. A tiltable bucket 32 best seen in (FIGS. 8 and 9) pivots on opposite side pins 33 and is provided with outlet 35, an overflow weir 36, a spout 38 projecting from the same end as the overflow weir, and a forked member 40 depending from the spout 38. When the door is in the substantially horizontal position B of FIGS. 1 and 4, whatever wetting agent is contained in the reservoir 29 drains toward the lowest point in the reservoir sump 30 (FIG. 4). As the user raises the door to the substantially vertical position A of FIGS. 1 and 3, some of the wetting agent in the reservoir sump 30 is trapped behind shelf 31 and then poured into the tiltable bucket 32. The excess of wetting agent required to fill the bucket then flows through overflow weir 36 (FIG. 8) of tiltable bucket 32 and back into reservoir 29 until only a capacity amount remains in the tiltable bucket 32.

Tiltable bucket 32 tips on pins 33 from a normal filling position approximately 15° above horizontal (FIG. 8) to a dispensing position approximately 5° below horizontal (FIG. 9) when actuated by a shaft 47 coupled to the fork member 40 of the tiltable bucket 32. The shaft 47 is equipped with lugs 50 and 51 and an extension 52. The lug 50 and the extension 52 hold the forked member 40 of the tiltable bucket 32 between them and cause the tiltable bucket to respond to movement of the shaft. The extra lug 51, which projects perpendicularly relative to the projection of the lug 50 and extension 52, aids in the assembly and engagement of the shaft end with fork 40 inside the sealed and typically opaque container. It prevents the lug 50 from being passed beyond the fork 40 when the shaft is inserted in a disposition rotated 90° from its final rotative disposition.

Figure 7:
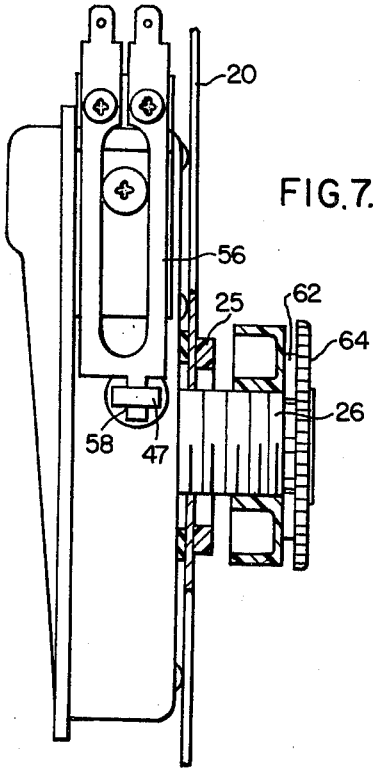
FIG. 7 is an end elevational view of the dispenser with selected parts in section.
Figure 6:
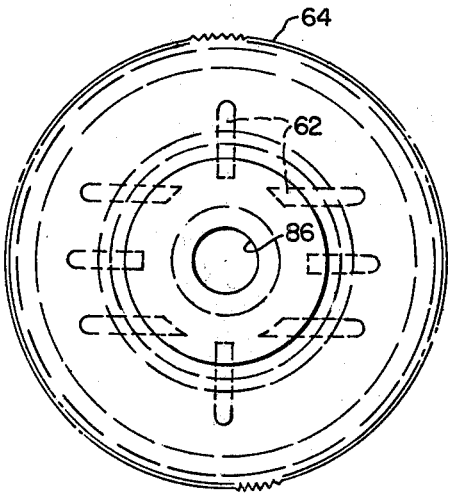
FIG. 6 is a front elevational view of the dispenser cap.

Movement of the shaft 47 which controls the movement of the tiltable bucket 32 is determined by an automatic control mechanism. One example of a control mechanism includes a bimetal element 56 (FIGS. 7 and 8) extending through an aperture 58 of shaft 47 and controlled by a timer (not shown) with the necessary electrical connections. When the timer causes the bimetal element 56 to be energized, the bimetal element heats up and deflects to the left from a FIG. 8 position to a FIG. 9 position causing shaft 47 to move the bucket 32 from its normally biased fill and hold position of FIG. 8 to the dispensing position of FIG. 9. When the pivotal bucket is in the position of FIG. 9, the capacity amount of fluid it contains will flow through outlet 35 and pour into trough 60 (also see FIG. 10), and then flow along trough 60 which slopes away from the dishchamber, to depending post 66 by gravity flow. The fluid then follows post 66 into conduit 26 which slopes toward the dishchamber. The fluid passes through conduit 26 and then through the baffle structure 62 of cap 64 (FIGS. 3 and 6) and into the dish chamber 12, again by gravity flow.

Figure 4:
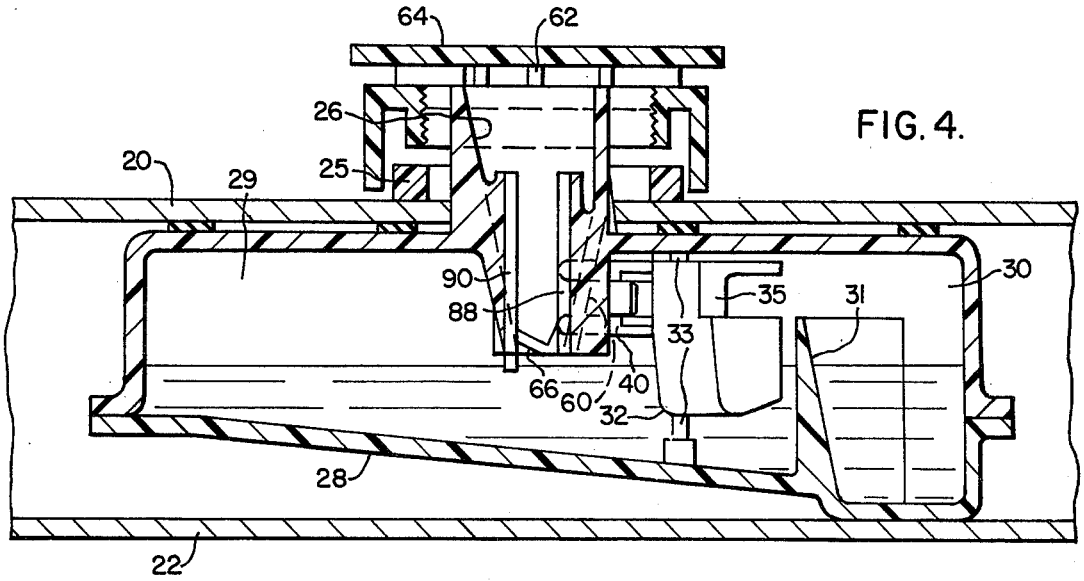
FIG. 4 is a cross sectional view of the dispenser taken along line III—III of FIG. 2 when the door is in the horizontal, open position B of FIG. 1, and with the level indicator rod omitted for clarity.
Figure 5:
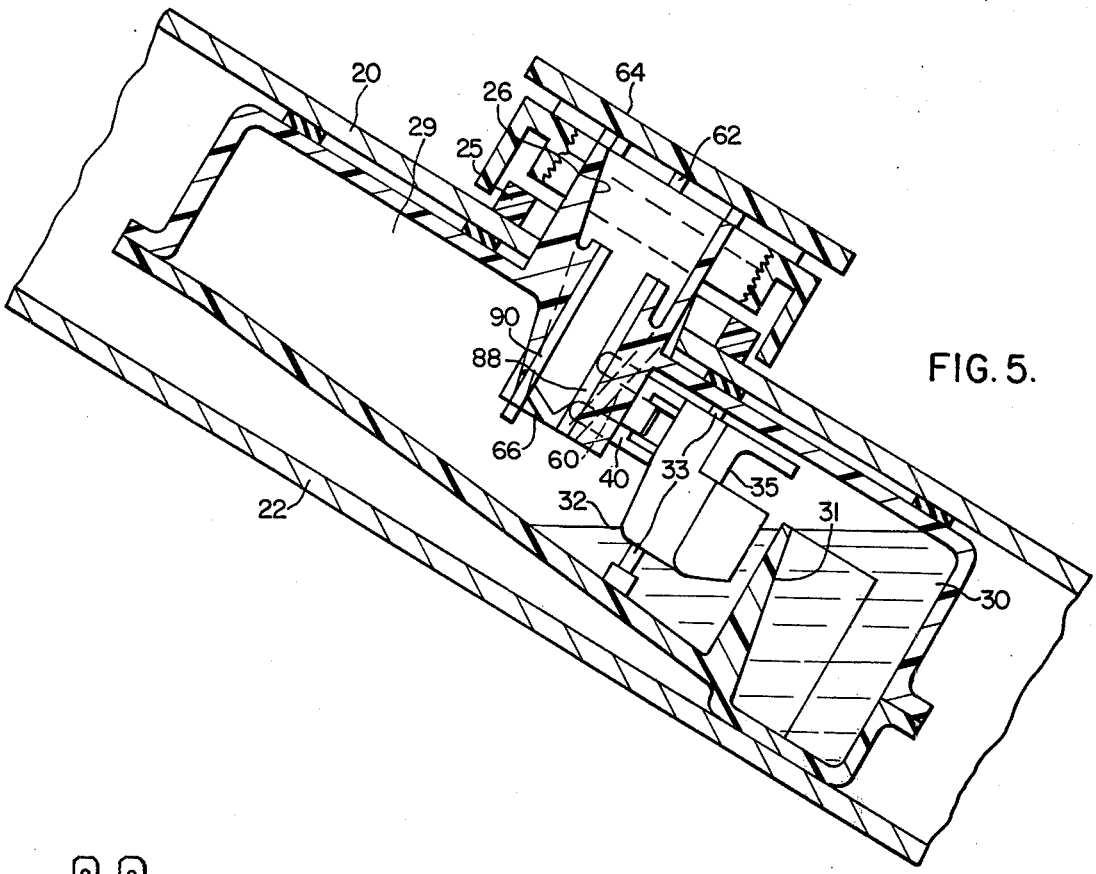
FIG. 5 is a cross sectional view of the dispenser taken along line III—III of FIG. 2 when the door is in the break-away position C of FIG. 1, and with the level indicator rod omitted for clarity.

The shaft 47 is so disposed within the dispenser that, when the dispenser has been properly filled, the shaft will remain above the level of the liquid whether the door is in the upright position (FIG. 3 and position A of FIG. 1), in the horizontal position (FIG. 4 and position B of FIG. 1), or in the break-away position (FIG. 5 and position C of FIG. 1). The position of this shaft will, therefore, prevent the dispenser from leaking along the shaft regardless of the position of thedoor as long as the reservoir is not overfilled.

Figure 8:
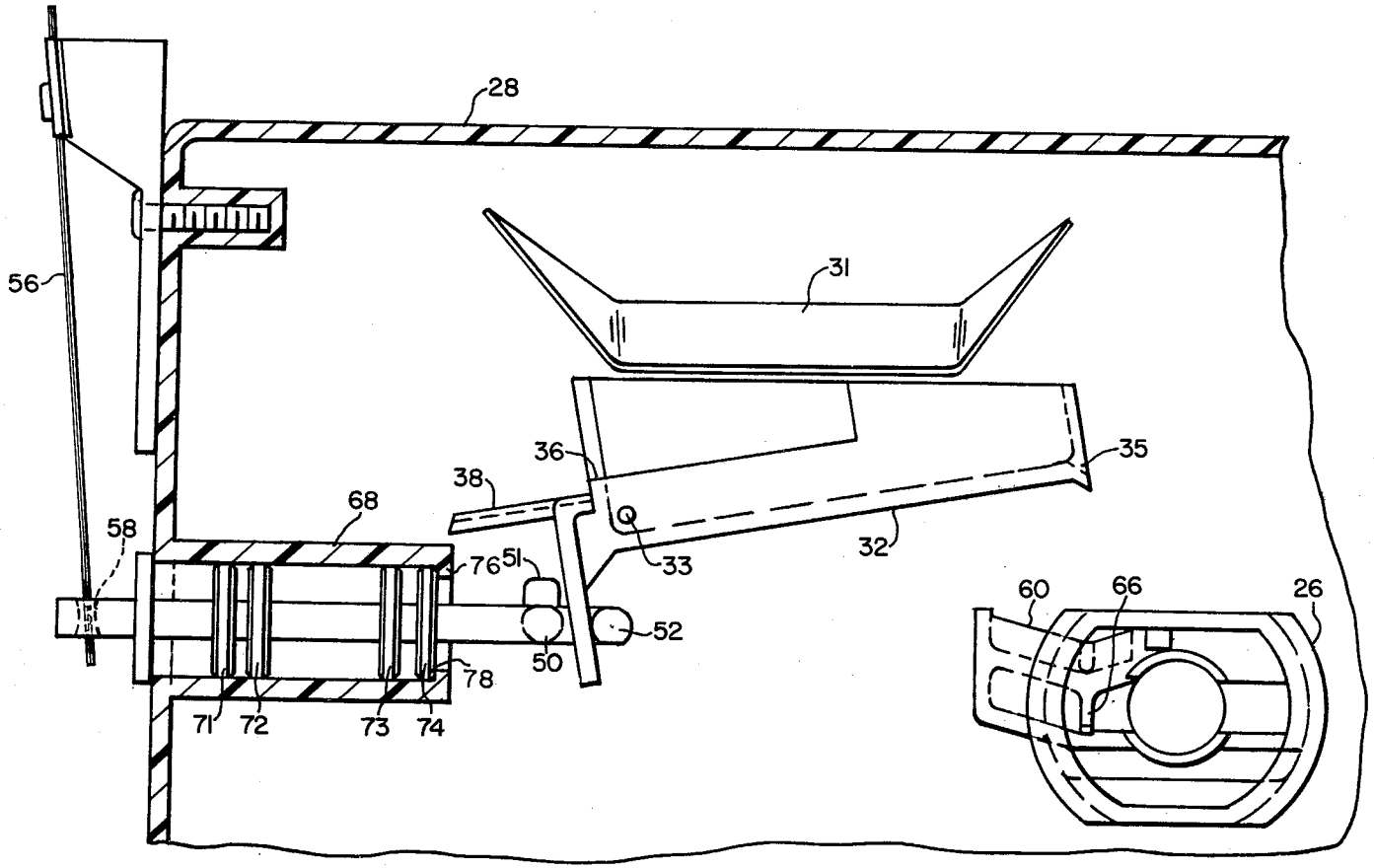
FIG. 8 is a partly-broken fragmentary face view of the portion of the dispenser containing the main operating parts and showing the bucket in a hold position.
Figure 9:
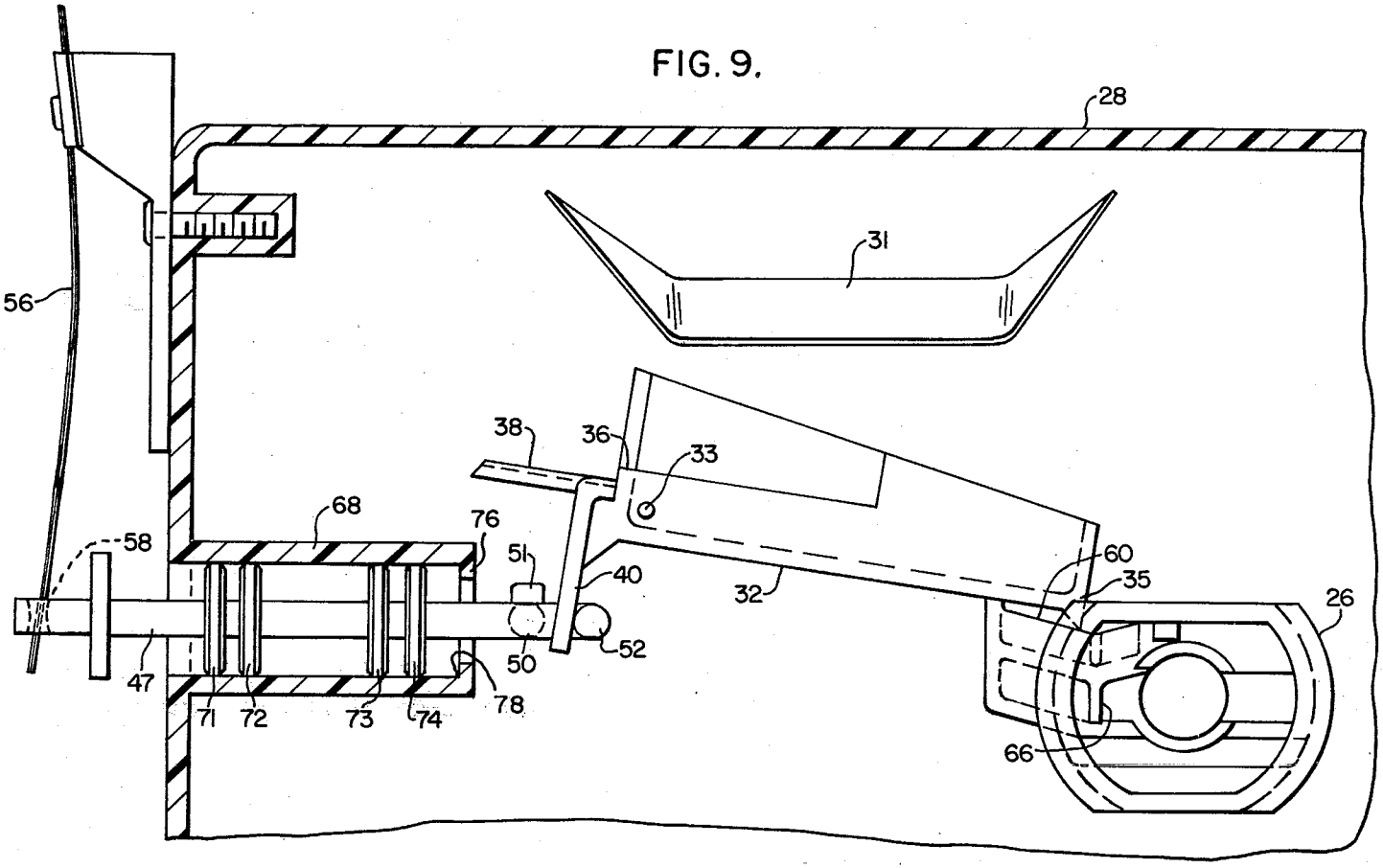
FIG. 9 is a view similar to FIG. 8, but with the bucket in a dump position.
Figure 10:
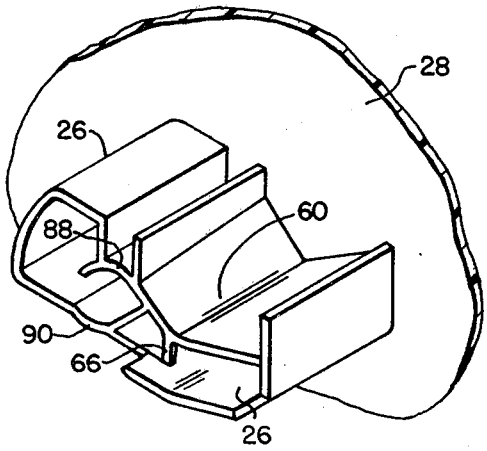
FIG. 10 is an isometric view of the inlet-outlet structure as seen from the inside of the dispenser.

To assure that the reservoir 29 will not be overfilled, the dispenser is arranged to effect an air lock upon filling. In order to form this air lock device, the shaft 47 passes through a cylinder 68 molded along with the dispenser outer wall 28 (FIGS. 8 and 9). Affixed to the shaft 47 and located within the cylinder 68 are two pairs of beveled rings 71, 72, 73, 74. At the right end of the cylinder 68 (FIG. 8), flange 76 frames port 78. Ring 74 is biased against flange 76 by bimetal element 56 to determine the normal filling position of the shaft 47 and the tiltable bucket 32. As the door is raised, the excess wetting agent poured into tiltable bucket 32 from shelf 31 passes through overflow weir 36. A portion of this overflow liquid will follow along the spout 38 and fall from the end upon shaft 47. A portion of the wetting agent falling upon the shaft will then be carried into the cylinder 68 when the shaft 47 is moved. When liquid has coated an area of the cylinder proximate to the entire circumference of any of the rings, surface tension of the wetting agent will cause the wetting agent to form a substantially air tight seal between the cylinder 68 and the circumference of the beveled rings 71, 72, 74 or 73. The rings are beveled on each side at the circumference to attract a greater volume of wetting agent around their circumference thereby promoting the integrity of the air tight seal. This substantially air tight seal around shaft 47 cooperates with the end of the conduit 26 which is inside the dispenser outer wall 28 to form an air lock within the dispenser to prevent it from being overfilled. The inner end of the conduit 26 (FIG. 4) in the container lies in a single plane substantially parallel to the plane of the inner and outer panels of the door 16. With the door in the substantially horizontal position B FIG. 1, the user manually fills the dispenser by removing the cap 64 and introducing wetting agent into the reservoir 29 through the conduit 26. Due to the substantially air tight seal around the shaft 47, the dispenser is substantially air tight except for the opening in conduit 26. When wetting agent rises, to the now substantially horizontal plane of the interior end of the conduit 26, an air lock is formed within the dispenser because the dispenser container is sealed save for the conduit and shaft means opening. This air lock will prevent the dispenser reservoir 29 from being filled above the plane of the inner end of conduit 26 thereby limiting the amount of liquid that can be introduced into the reservoir to a predetermined amount and restricting the liquid level in the dispenser to a point which is always below shaft 47 whether the door is in position A, B or C of FIG. 1.

FIG. 3 also shows a translucent rod 84 which will allow the user to determine when the reservoir 29 should be refilled. The translucent rod 84 extends through the hole 86 in cap 64 and is held by brackets 88 and 90 (also see FIG. 11). The translucent rod has a conical end 92 inside the dispenser which abuts the inside of the outer wall 28. The translucent rod transmits light unidirectionally so that when the door 16 is in the substantially horizontal position, the outer, exposed end of the rod will indicate whether the conical end 92 is covered by wetting agent. Since the outer end of the translucent rod is visible to the user, the user can determine whether the reservoir 29 demands refilling without removing the cap. Since the translucent rod is fixed in the charge-discharge conduit by mounting means comprising brackets 88 and 90, and not to the cap 64, this rod may be used while filling the reservoir.

Alternatively, the rod may be used to determine the point at which the reservoir is full. The distance by which the base of the conical end 92 of the rod is removed from the outer wall 28 will determine the point at which the translucent rod will indicate the presence of a liquid. By placing the base of this conical end 92 in a same plane as the internal end of the conduit 26, the rod would indicate the point at which the air lock would be formed and the conduit would begin to fill. This translucent rod liquid level indicator for preventing overfilling of the dispenser is independent of the air lock arrangement which prevents overfilling of the dispenser reservoir.

Referring to FIG. 11, the outwardly projecting, threaded portion 26 of the charge-discharge conduit is shown as being of generally circular shape along the sides and with a top and a bottom flat 93 and 94. This projecting portion 26 is to be received through the generally complementary shaped hole 83 in the inner panel 20 and a nut 25 (FIG. 7) is then received on the outwardly projecting portion for securing the dispenser container to the inner panel. The top flat 93 carries a pair of inclined plane wedges 95 which taper toward the outer open end of the conduit. The hole 83 is made slightly larger than the outer dimensions of the conduit but only to the degree that when the conduit is received in the opening 83 and the nut 25 is turned up tightly on the threads to hold the container to the panel, the wedges serve to force the bottom flat 94 into tightly seating abutment with the straight bottom edge 96 of the opening. As a result, it is assured that the correct orientation of the dispenser relative to the panel, with respect to rotation of one relative to the other about an axis through the conduit, is obtained. This is particularly important with the tilted bucket type of dispensing mechanism which has only slight angular movement from a hold to a dump position, and must be in the correct angular disposition in the hold position to contain the proper amount of rinse agent to be dispensed. This mounting arrangement also results in the avoidance of requiring extra inter engaging parts at a location apart from the conduit location for the purpose of establishing the proper orientation. Additionally, it permits slightly greater tolerances for the dimensions of the conduit and the opening in the inner panel.

I claim:

1. In a front-loading dishwasher having an in-door liquid dispenser of the type in which liquid in the dispenser container is transferred to a volume-metering dispensing element through movement of the door from an open, horizontal position to a closed, vertical position, an arrangement comprising: a single, open-ended, charge-discharge conduit disposed through the wall of said container which faces the dishwasher chamber when the door is in a vertical position for both charging said container with liquid and for discharging the liquid to the dishwasher chamber, said conduit having its end which opens into the chamber disposed at a level above a level of liquid therein predetermined to constitute a full charge in said container when said door is in a vertical position; a tiltable bucket having a hold and a dump position in said container serving as said volume-metering dispensing element, said bucket being located in said container in a position to dispense a predetermined charge of liquid into said conduit when said bucket is in a dump position; means interior of said container and including a portion of said container for trapping a quantity of the container carried liquid when the door is opened to at least a horizontal disposition and for delivering trapped liquid to and charging said bucket when said door is moved back to a closed vertical disposition; shaft means extending in substantially sealed relation through an opening in the wall of said container and operatively connected to said bucket for positioning said bucket in said positions.

2. An arrangement according to claim 1 wherein:

said charge-discharge conduit includes a portion projecting inwardly into said container interior;

said bucket is so disposed relative to said inwardly projecting portion that liquid drains onto a surface of said portion when said bucket is in a dump position; and said arrangement further comprises means to carry said liquid from said surface to the interior of said conduit for discharge from the dispenser to the dishwasher chamber.

3. An arrangement according to claim 2 wherein:

said inwardly projecting portion of said conduit includes a trough-shaped top outer surface inclined to lead liquid away from said chamber when said door is in a vertical position, and a bottom interior surface inclined toward said chamber when said door is in a vertical position; and said means to carry said liquid comprises an inclined post along which liquid follows from said top outer surface to said bottom interior surface.

4. An arrangement according to claim 2 including:

a translucent rod, liquid level indicator; and said inwardly projecting portion includes means for mounting said rod in said conduit.

5. An arrangement according to claim 1 wherein:

said opening in said wall of said container is defined by wall means being generally cylindrical in form; and said shaft means includes a plurality of separate, disc-shaped elements having circumferences in close fitting relation to the interior surface of said cylindrical opening.

6. An arrangement according to claim 5, wherein said bucket is so disposed in said hold position that excess liquid received from said delivery and charging means flows out an end of said bucket adjacent said cylindrical opening; and means in said container direct said excess liquid to said opening to promote a liquid seal between the circumference of said elements and the interior of said cylindrical opening.

7. An arrangement according to claim 6 wherien:

said bucket includes a weir at said end adjacent said opening; and said means to direct said liquid to said opening comprises an element projecting from said bucket adjacent said weir for leading said excess liquid to said opening.

* * * * *